US010610997B2

(12) United States Patent
Xue et al.

(10) Patent No.: US 10,610,997 B2
(45) Date of Patent: Apr. 7, 2020

(54) WHEEL ASSEMBLY EQUIPMENT

(71) Applicant: CITIC Dicastal CO.,LTD, Qinhuangdao (CN)

(72) Inventors: Bowen Xue, Qinhuangdao (CN); Qi Cang, Qinhuangdao (CN); Ruisong Tong, Qinhuangdao (CN); Jiandong Guo, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 133 days.

(21) Appl. No.: 15/937,189

(22) Filed: Mar. 27, 2018

(65) Prior Publication Data

US 2019/0193240 A1 Jun. 27, 2019

(30) Foreign Application Priority Data

Dec. 22, 2017 (CN) ..... 2017 1 1400475

(51) Int. Cl.

| | |
|---|---|
| ***B23Q 3/00*** | (2006.01) |
| ***B24B 41/06*** | (2012.01) |
| ***B24B 47/10*** | (2006.01) |
| ***B24B 5/44*** | (2006.01) |

(52) U.S. Cl.

CPC ..... *B24B 41/06* (2013.01); *B24B 5/44* (2013.01); *B24B 47/10* (2013.01)

(58) Field of Classification Search

USPC ..... 269/13, 46, 47, 48, 48.1

See application file for complete search history.

(56) References Cited

U.S. PATENT DOCUMENTS

| | | | | |
|---|---|---|---|---|
| 2003/0145466 | A1* | 8/2003 | Baek | B21D 53/30 29/894.322 |
| 2007/0098315 | A1* | 5/2007 | Komori | B60B 27/00 384/544 |
| 2010/0172705 | A1* | 7/2010 | Sammartin | B23Q 3/183 408/1 R |

* cited by examiner

*Primary Examiner* — Joseph J Hail
*Assistant Examiner* — Shantese L McDonald
(74) *Attorney, Agent, or Firm* — Calfee, Halter & Griswold LLP

(57) ABSTRACT

The present application discloses a wheel assembly equipment, which includes a lower rotating and lifting system, lower ejection units, a lower supporting and adjusting system, a centering and lifting system, compression units, press-in units, an upper lifting and rotating system. The wheel assembly equipment not only may be used for realizing the function of simultaneously pressing bushings into bolt holes of a wheel having different pitch diameters, but also may be used for simultaneously detecting whether the press-out force of each bushing is qualified, and has the characteristics of high automation degree, advanced process, strong universality and high safety and stability at the same time.

1 Claim, 3 Drawing Sheets

WHEEL ASSEMBLY EQUIPMENT

CROSS-REFERENCE TO RELATED APPLICATIONS

This application claims priority to Chinese Patent Application No. 201711400475.X, filed on Dec. 22, 2017, which is hereby incorporated by reference in its entirety.

TECHNICAL FIELD

The present application relates to an assembly equipment, and specifically, to a wheel bushing assembly equipment.

BACKGROUND ART

In the running process of an aluminum alloy wheel, all axial force and lateral force are borne to bolt holes. Due to the influence of structures of some wheels, the strength at a bolt hole usually cannot meet the design requirement, and a bushing needs to be pressed into the bolt hole at the moment to meet the strength requirement. However, there is still no equipment with high degree of automation at present for assembling bushings, to meet the requirement for simultaneously assembling bushings at bolt holes of a wheel having different pitch diameters. In addition, the bushings need to satisfy certain press-out force in the assembly process to ensure that the bushings do not drop in the mounting process of the wheel, this press-out force needs to be detected periodically, and the traditional method for detecting the press-out force is to press wheel bushings in, then take the wheel down and press the bushings out on special press-out equipment, so the efficiency is very low.

SUMMARY OF THE INVENTION

The aim of the present application is to provide wheel assembly equipment, which not only may be used for realizing the function of simultaneously pressing bushings into bolt holes of a wheel having different pitch diameters, but also may be used for simultaneously detecting whether the press-out force of each bushing is qualified.

In order to fulfill the above aim, the technical solution of the present application is: wheel assembly equipment includes a frame, a cylinder I, a lower rotary joint, a lower spline shaft, a belt pulley I, a lower spline sleeve, lower guide posts, lower guide sleeves, a lower fixed plate, a lower bearing seat, a rotary bottom plate, a servo motor I, a gear I, racks I, servo electric cylinders I, left sliding plates I, guide rails I, guide posts I, lower pressure sensors, guide sleeves I, springs I, floating columns I, a spring II, a floating column II, a flange plate, a cylinder II, a gear II, a sliding rack, racks II, guide rails II, guide rails III, a left sliding plate II, clamping blocks, compression blocks, guide posts II, guide sleeves II, left sliding plates III, guide rails IV, servo electric cylinders II, cylinders III, an upper fixed plate I, a gear III, racks III, a servo motor II, a swivel, an upper fixing ring, upper guide posts, an upper fixed plate II, an upper spline shaft, a belt pulley III, an upper spline sleeve, an upper bearing seat I, upper guide sleeves, an upper rotary joint, a cylinder IV, a servo motor III, an upper bearing seat II, a rotating shaft, a synchronous belt II, a belt pulley IV, servo electric cylinders III, right sliding plates I, guide rails V, guide sleeves UI, guide posts III, upper pressure sensors, upper pressure heads, clamping jaws, springs III, a right sliding plate, a servo motor IV, a synchronous belt I, a belt pulley II and cylinders V.

A lower rotating and lifting system includes: the lower bearing seat is fixed above the lower fixed plate; the lower spline sleeve is mounted inside the lower bearing seat via a bearing; the lower spline shaft is matched with the lower spline sleeve, and the lower end thereof is mounted above the lower rotary joint; the cylinder I is fixed at the bottom of the frame, and the output end thereof is connected with the lower part of the lower rotary joint; the belt pulley I is fixed below the lower spline sleeve; the servo motor IV is fixed above the lower fixed plate, and the belt pulley II is fixed at the output end of the servo motor IV; and the belt pulley I is connected with the belt pulley II via the synchronous belt I.

A lower ejection unit includes: the left sliding plate I is fixed below the flange plate via the guide rail I; the guide sleeve I is fixed above the left sliding plate I; the guide post I is matched with the guide sleeve I; the lower pressure sensor is arranged in the middle of the guide post I; the floating column I is matched with a cylindrical hole in the upper part of the guide sleeve I; the spring I is arranged below the floating column I; the servo electric cylinder I is arranged below the left sliding plate I, and the output end thereof is connected with the lower part of the guide post I; and the quantity of the lower ejection unit of this equipment corresponds to that of bolt holes of a wheel.

A lower supporting and adjusting system includes: the flange plate is fixed above the rotary bottom plate via a vertical plate; the lower guiding part of the floating column II is matched with a hole in the middle of the flange plate; the spring II is arranged outside the lower guiding part of the floating column II; the servo motor I is fixed below the flange plate, and the gear I is fixed at the output end of the servo motor I; a rack I is fixed on each left sliding plate I, and all the racks I are engaged with the gear I.

A centering and lifting system includes; both the left sliding plate II and the right sliding plate are mounted above a bottom plate of the sliding rack via the guide rails III; the two clamping blocks are respectively fixed above the left sliding plate II and the right sliding plate, and the racks II are respectively fixed below the left sliding plate II and the right sliding plate; the gear II is fixed above a bottom plate of the sliding rack, and engaged with the racks II; the two sides of the sliding rack are mounted on the two sides of the frame via the guide rails II; the cylinder II is fixed above the bottom plate of the sliding rack, and the output end thereof is connected with the left sliding plate II; the four lower guide posts are fixed below the bottom plate of the sliding rack; the lower guide posts are matched with the lower guide sleeves; the lower guide sleeves are fixed on the lower fixed plate; the two cylinders V are also fixed on the lower fixed plate, and the output ends thereof are articulated with the lower part of the bottom plate of the sliding rack.

A compression unit includes: the left sliding plate III is mounted below the upper fixed plate I via the guide rail IV; the guide sleeve II is fixed below the left sliding plate III; the guide post H is matched with the guide sleeve II, and the compression block is fixed below the guide post II; the cylinder III is fixed above the left sliding plate III, and the output end thereof is connected with the upper part of the guide post II; the servo electric cylinder II is fixed below the upper fixed plate I, and the output end thereof is connected with the left sliding plate III; and this equipment includes four compression units, the four compression units are uniformly distributed below the upper fixed plate I.

A press-in unit includes: the right sliding plate I is mounted above the upper fixed plate I via the guide rail V; the guide sleeve III is fixed below the right sliding plate I;

the guide post III is matched with the guide sleeve III, and the upper pressure head is fixed below the guide post III; the upper pressure sensor is arranged inside the guide post III; the upper parts of the four clamping jaws are T-shaped, and matched with four T-shaped grooves in the upper pressure head; a semicircular stop block is respectively arranged on the lower outer sides of the clamping jaws; the spring III is arranged among the four clamping jaws; the servo electric cylinder III is fixed at the top of the right sliding plate I, and the output end thereof is connected with the upper part of the guide post III; and the quantity of the press-in unit corresponds to that of the bolt holes of the wheel.

A servo motor II is fixed above the upper fixed plate I, and the gear III is fixed at the output end of the servo motor II; a rack III is fixed on each right sliding plate I, and the racks III are simultaneously engaged with the gear III.

An upper lifting and rotating system includes: the upper fixed plate II is fixed above the upper fixed plate I; the upper fixing ring is mounted above the upper fixed plate II via the swivel; the four upper guide posts are fixed on the upper fixing ring; the four upper guide sleeves matched with the upper guide posts are fixed above the frame; the upper bearing seat I is fixed in the middle below a top plate of the frame; the upper spline sleeve is mounted inside the upper bearing seat I via a bearing; the upper spline shaft is matched with the upper spline sleeve, the upper part thereof is connected with the lower end of the upper rotary joint, and the lower part is connected with the top of the upper fixed plate II; the belt pulley III is fixed below the upper spline sleeve; the cylinder IV is fixed at the top of the frame, and the output end thereof is connected with the upper end of the upper rotary joint; the upper bearing seat II is fixed on the right side below the top plate of the frame; the rotating shaft is mounted inside the upper bearing seat II via a bearing; the servo motor III is fixed above the frame; the belt pulley IV is fixed below the rotating shaft; and the belt pulley III is connected with the belt pulley IV via the synchronous belt II.

In the working process, the cylinder II drives the four clamping blocks via the gear II and the racks II to synchronously center and clamp a wheel; the cylinders V drive the wheel via the lower guide posts and the guide rails II to descend; the positions of each guide sleeve I and each floating column I are adjusted under the drive of the servo motor I via the gear I, the racks I and the guide rails I, so that the formed pitch diameters are equal to the pitch diameters of bolt holes of the wheel; the servo motor IV drives the lower spline shaft and each floating column I via the synchronous belt I to rotate; when the axis of each floating column I is coaxial with the axis of each bolt hole of the wheel, the lower spline shaft and each floating column I stops rotating; the cylinder I drives each floating column I via the lower spline shaft to ascend in a jacked manner, so that each floating column I is matched with each bolt hole of the wheel, the floating column II is matched with a center hole of the wheel, and the upper end face of the flange plate is flush with a flange of the wheel; the axis positions of each upper pressure head are adjusted under the drive of the servo motor II via the gear III, the racks III and the guide rails V, so that the pitch diameters formed by the axes of the upper pressure heads are equal to the pitch diameters of the bolt holes of the wheel; the servo motor III drives the upper spline sleeve and the upper spline shaft via the rotating shaft and the synchronous belt II to rotate; the upper spline shaft drives each upper pressure head via the swivel to rotate, and when the axis of each upper pressure head is coaxial with the axis of each bolt hole of the wheel, each upper pressure head stops rotating; the cylinder IV drives each upper pressure head via the upper spline shaft and the upper guide post to descend; the radial positions of the compression blocks are adjusted under the drive of the servo electric cylinders II via the guide rails IV, so that the compression blocks are arranged above an upper flange of the wheel; the cylinders III drive the compression blocks via the guide posts II to compress the front side of the wheel; a bushing arranged below each upper pressure head can be simultaneously pressed into each bolt hole of the wheel under the drive of the servo electric cylinder III via the guide post III, and the press-in force value of each bushing can be acquired via the upper pressure sensor; each bushing can be separately ejected out of the bolt hole of the wheel under the drive of the servo electric cylinder I via the upper end face of the guide post I, and whether the press-out force of each bushing is qualified can be detected via the lower pressure sensor.

The present application not only may be used for realizing the function of simultaneously pressing bushings into bolt holes of a wheel having different pitch diameters, but also may be used for simultaneously detecting whether the press-out force of each bushing is qualified, and has the characteristics of high automation degree, advanced process, strong universality and high safety and stability at the same time.

Figure 1:
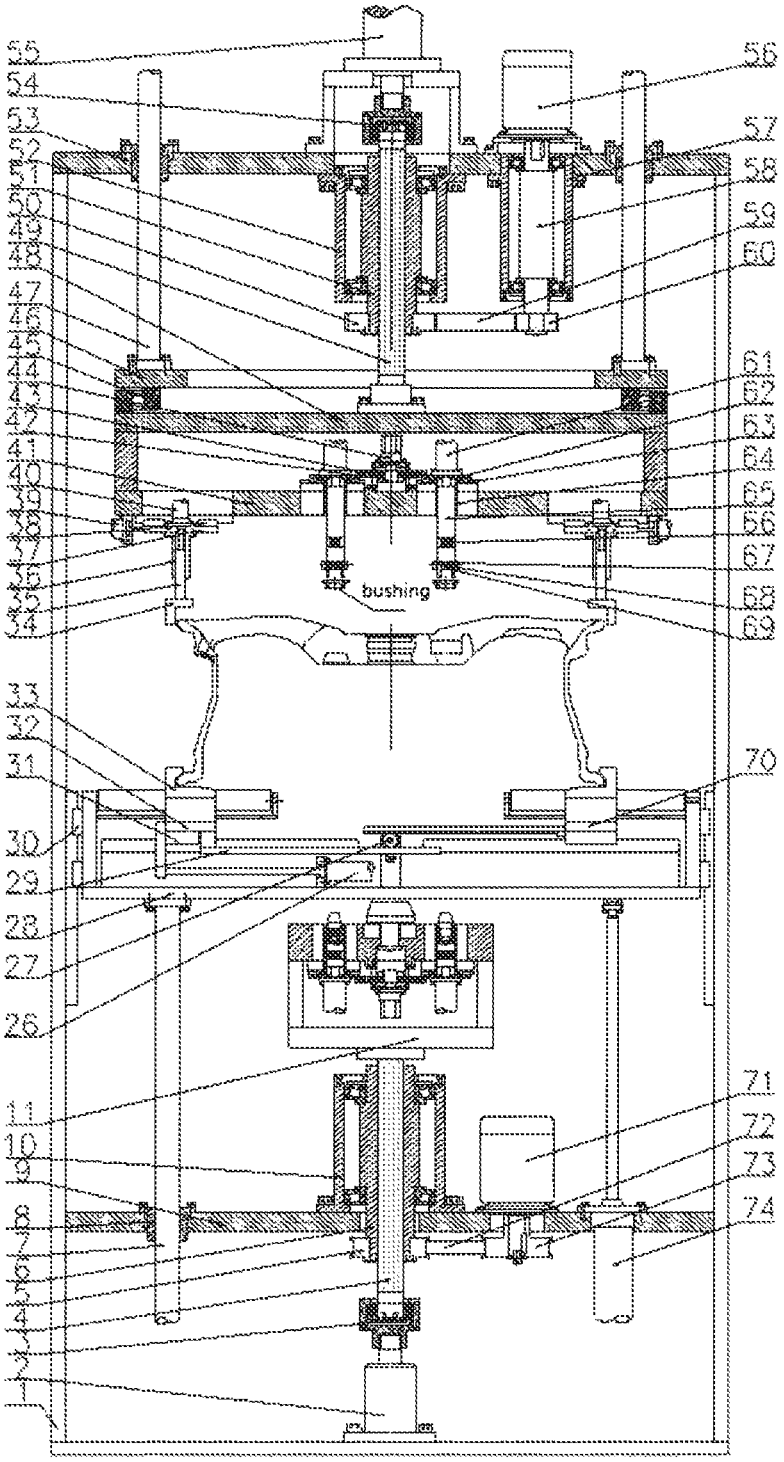
FIG. 1 is a front view of wheel assembly equipment of the present application.
Figure 2:
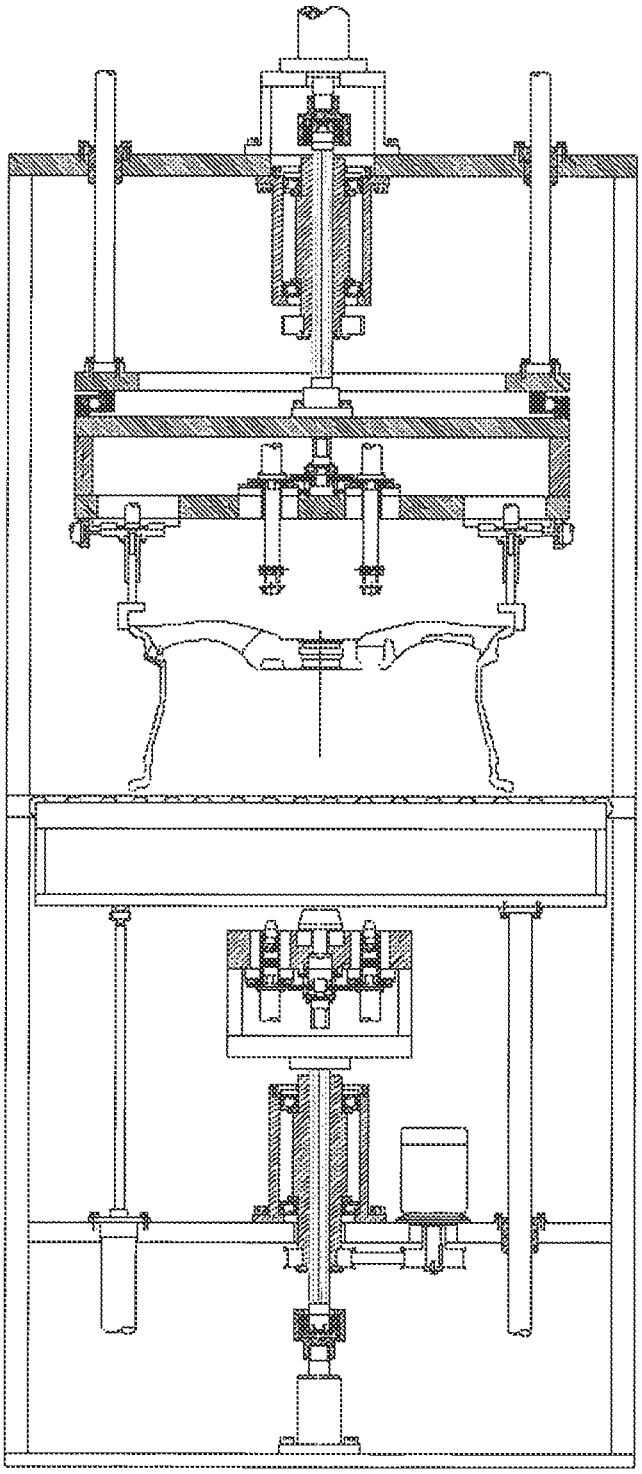
FIG. 2 is a left view of the wheel assembly equipment of the present application.
Figure 3:
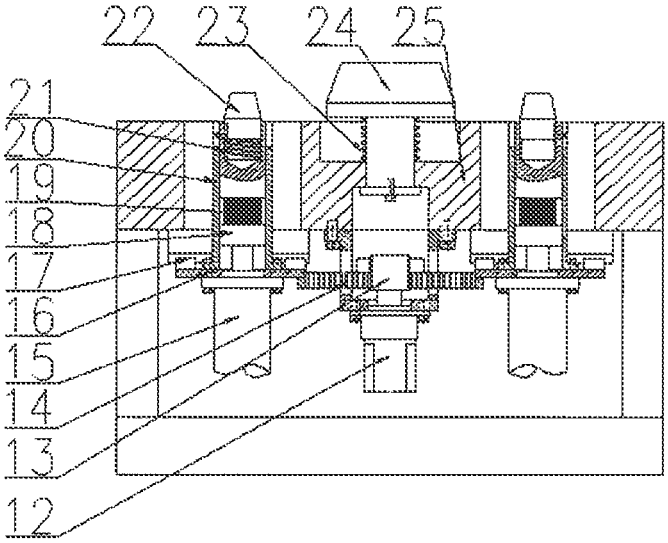
FIG. 3 is a front view of lower ejection units and a lower supporting and adjusting system of the wheel assembly equipment of the present application.
Figure 4:
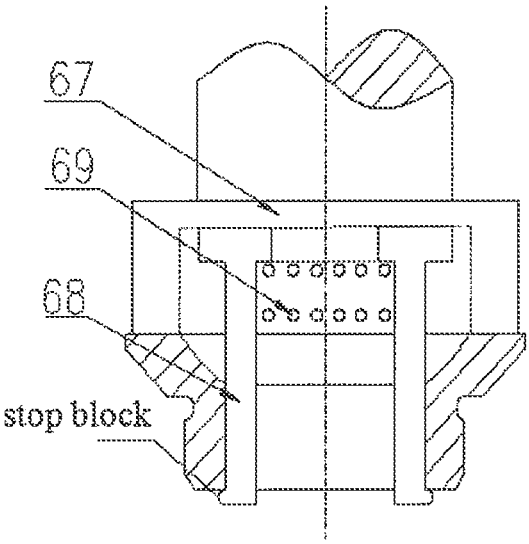
FIG. 4 is a front view after lower pressure heads and clamping jaws of the wheel assembly equipment of the present application clamp bushings.

In which, 1—frame, 2—cylinder I, 3—lower rotary joint, 4—lower spline shaft, 5—belt pulley I, 6—lower spline sleeve, 7—lower guide post, 8—lower guide sleeve, 9—lower fixed plate, 10—lower bearing seat, 11—rotary bottom plate, 12—servo motor I, 13—gear I, 14—rack I, 15—servo electric cylinder I, 16—left sliding plate I, 17—guide rail I, 18—guide post I, 19—lower pressure sensor, 20—guide sleeve I, 21—spring I, 22—floating column I, 23—spring II, 24—floating column II, 25—flange plate, 26—cylinder II, 27—gear II, 28—sliding rack, 29—rack II, 30—guide rail II, 31—guide rail III, 32—left sliding plate II, 33—clamping block, 34—compression block, 35—guide post 36—guide sleeve II, 37—left sliding plate III, 38—guide rail IV, 39—servo electric cylinder II, 40—cylinder III, 41—upper fixed plate I, 42—gear III, 43—rack III, 44—servo motor II, 45—swivel, 46—upper fixing ring, 47—upper guide post, 48—upper fixed plate II, 49—upper spline shaft, 50—belt pulley III,51—upper spline sleeve, 52—upper bearing seat I, 53—upper guide sleeve, 54—upper rotary joint, 55—cylinder IV, 56—servo motor III, 57—upper bearing seat II, 58—rotating shaft, 59—synchronous belt II, 60—belt pulley IV, 61—servo electric cylinder III, 62—right sliding plate I, 63—guide rail V, 64—guide sleeve 65—guide post III, 66—upper pressure sensor, 67—upper pressure head, 68—clamping jaw, 69—spring III, 70—right sliding plate, 71—servo motor IV, 72—synchronous belt I, 73—belt pulley II, 74—cylinder V.

DETAILED DESCRIPTION OF THE INVENTION

Specific details and working conditions of equipment provided by the present application will be described below in combination with the accompanying drawings.

The equipment includes a frame 1, a cylinder I 2, a lower rotary joint 3, a lower spline shaft 4, a belt pulley I 5, a lower spline sleeve 6, lower guide posts 7, lower guide sleeves 8, a lower fixed plate 9, a lower bearing seat 10, a rotary bottom plate 11, a servo motor I 12, a gear I 13, racks I 14, servo electric cylinders I 15, left sliding plates I 16, guide rails I 17, guide posts I 18, lower pressure sensors 19, guide sleeves I 20, springs 21, floating columns I 22, a spring II 23, a floating column II 24, a flange plate 25, a cylinder II 26, a gear II 27, a sliding rack 28, racks II 29, guide rails II 30, guide rails III 31, a left sliding plate II 32, clamping blocks 33, compression blocks 34, guide posts II 35, guide sleeves II 36, left sliding plates III 37, guide rails IV 38, servo electric cylinders II 39, cylinders III 40, an upper fixed plate I 41, a gear III 42, racks III 43, a servo motor II 44, a swivel 45, an upper fixing ring 46, upper guide posts 47, an upper fixed plate II 48, an upper spline shaft 49, a belt pulley III 50, an upper spline sleeve 51, an upper bearing seat I 52, upper guide sleeves 53, an upper rotary joint 54, a cylinder IV 55, a servo motor III 56, an upper bearing seat II 57, a rotating shaft 58, a synchronous belt II 59, a belt pulley IV 60, servo electric cylinders III 61, right sliding plates I 62, guide rails V 63, guide sleeves III 64, guide posts III 65, upper pressure sensors 66, upper pressure heads 67, clamping jaws 68, springs III 69, a right sliding plate 70, a servo motor IV 71, a synchronous belt I 72, a belt pulley II 73 and cylinders V 74.

A lower rotating and lifting system includes: the lower bearing seat 10 is fixed above the lower fixed plate 9; the lower spline sleeve 6 is mounted inside the lower bearing seat 10 via a bearing; the lower spline shaft 4 is matched with the lower spline sleeve 6, and the lower end thereof is mounted above the lower rotary joint 3; the cylinder 12 is fixed at the bottom of the frame 1, and the output end thereof is connected with the lower part of the lower rotary joint 3; the belt pulley 15 is fixed below the lower spline sleeve 6; the servo motor IV 71 is fixed above the lower fixed plate 9, and the belt pulley II 73 is fixed at the output end of the servo motor IV 71; and the belt pulley I 5 is connected with the belt pulley II 73 via the synchronous belt I 72.

A lower ejection unit includes: the left sliding plate I 16 is fixed below the flange plate 25 via the guide rail I 17; the guide sleeve I 20 is fixed above the left sliding plate I 16; the guide post I 18 is matched with the guide sleeve I 20; the lower pressure sensor 19 is arranged in the middle of the guide post I 18; the floating column I 22 is matched with a cylindrical hole in the upper part of the guide sleeve 20; the spring I 21 is arranged below the floating column I 22; the servo electric cylinder I 15 is arranged below the left sliding plate I 16, and the output end thereof is connected with the lower part of the guide post I 18; and the quantity of the lower ejection unit of this equipment corresponds to that of bolt holes of a wheel.

A lower supporting and adjusting system includes: the flange plate 25 is fixed above the rotary bottom plate 11 via a vertical plate; the lower guiding part of the floating column II 24 is matched with a hole in the middle of the flange plate 25; the spring II 23 is arranged outside the lower guiding part of the floating column II 24; the servo motor I 12 is fixed below the flange plate 25, and the gear I 13 is fixed at the output end of the servo motor I 12; a rack I 14 is fixed on each left sliding plate I 16, and all the racks I 14 are engaged with the gear I 13.

A centering and lifting system includes: both the left sliding plate II 32 and the right sliding plate 70 are mounted above a bottom plate of the sliding rack 28 via the guide rails III 31; the two clamping blocks 33 are respectively fixed above the left sliding plate II 32 and the right sliding plate 70, and the racks II 29 are respectively fixed below the left sliding plate II 32 and the right sliding plate 70; the gear II 27 is fixed above a bottom plate of the sliding rack 28, and engaged with the racks II 29; the two sides of the sliding rack 28 are mounted on the two sides of the frame I via the guide rails II 30; the cylinder II 26 is fixed above the bottom plate of the sliding rack 28, and the output end thereof is connected with the left sliding plate II 32; the four lower guide posts 7 are fixed below the bottom plate of the sliding rack 28; the lower guide posts 7 are matched with the lower guide sleeves 8; the lower guide sleeves 8 are fixed on the lower fixed plate 9; the two cylinders V 74 are also fixed on the lower fixed plate 9, and the output ends thereof are articulated with the lower part of the bottom plate of the sliding rack 28.

A compression unit includes: the left sliding plate III 37 is mounted below the upper fixed plate I 41 via the guide rail IV 38; the guide sleeve II 36 is fixed below the left sliding plate III 37; the guide post II 35 is matched with the guide sleeve II 36, and the compression block 34 is fixed below the guide post II 35; the cylinder III 40 is fixed above the left sliding plate III 37, and the output end thereof is connected with the upper part of the guide post II 35; the servo electric cylinder II 39 is fixed below the upper fixed plate I 41, and the output end thereof is connected with the left sliding plate III 37; and this equipment includes four compression units, the four compression units are uniformly distributed below the upper fixed plate I 41.

A press-in unit includes: the right sliding plate I 62 is mounted above the upper fixed plate I 41 via the guide rail V 63; the guide sleeve III 64 is fixed below the right sliding plate I 62; the guide post III 65 is matched with the guide sleeve III 64, and the upper pressure head 67 is fixed below the guide post III 65; the upper pressure sensor 66 is arranged inside the guide post III 65; the upper parts of the four clamping jaws 68 are T-shaped, and matched with four T-shaped grooves in the upper pressure head 67; a semicircular stop block is respectively arranged on the lower outer sides of the clamping jaws 68; the spring III 69 is arranged among the four clamping jaws 68; the servo electric cylinder III 61 is fixed at the top of the right sliding plate 162, and the output end thereof is connected with the upper part of the guide post III 65; and the quantity of the press-in unit corresponds to that of the bolt holes of the wheel.

A servo motor II 44 is fixed above the upper fixed plate I 41, and the gear III 42 is fixed at the output end of the servo motor II 44; a rack III 43 is fixed on each right sliding plate 162, and the racks III 43 are simultaneously engaged with the gear III 42.

An upper lifting and rotating system includes: the upper fixed plate II 48 is fixed above the upper fixed plate I 41; the upper fixing ring 46 is mounted above the upper fixed plate II 48 via the swivel 45; the four upper guide posts 47 are fixed on the upper fixing ring 46; the four upper guide sleeves 53 matched with the upper guide posts 47 are fixed above the frame 1; the upper bearing seat I 52 is fixed in the middle below a top plate of the frame 1; the upper spline sleeve 51 is mounted inside the upper bearing seat I 52 via a bearing; the upper spline shaft 49 is matched with the upper spline sleeve 51, the upper part thereof is connected with the lower end of the upper rotary joint 54, and the lower part is connected with the top of the upper fixed plate II 48; the belt pulley III 50 is fixed below the upper spline sleeve 51; the cylinder IV 55 is fixed at the top of the frame 1, and the output end thereof is connected with the upper end of the upper rotary joint 54; the upper bearing seat II 57 is fixed on the right side below the top plate of the frame 1; the rotating shaft 58 is mounted inside the upper bearing seat II 57 via a bearing; the servo motor III 56 is fixed above the frame 1; the belt pulley IV 60 is fixed below the rotating shaft 58; and the belt pulley III 50 is connected with the belt pulley IV 60 via the synchronous belt II 59.

In the working process, the cylinder II 26 drives the four clamping blocks 33 via the gear II 27 and the racks II 29 to synchronously center and clamp a wheel; the cylinders V 74 drive the wheel via the lower guide posts 7 and the guide rails II 30 to descend; the positions of each guide sleeve I 20 and each floating column I 22 are adjusted under the drive of the servo motor I 12 via the gear I 13, the racks I 14 and the guide rails I 17, so that the formed pitch diameters are equal to the pitch diameters of bolt holes of the wheel; the servo motor IV 71 drives the lower spline shaft 4 and each floating column I 22 via the synchronous belt I 72 to rotate; when the axis of each floating column I 22 is coaxial with the axis of each bolt hole of the wheel, the lower spline shaft 4 and each floating column I 22 stops rotating; the cylinder I 2 drives each floating column I 22 via the lower spline shaft 4 to ascend in a jacked manner, so that each floating column I 22 is matched with each bolt hole of the wheel, the floating column II 24 is matched with a center hole of the wheel, and the upper end face of the flange plate 25 is flush with a flange of the wheel; the axis positions of each upper pressure head 67 are adjusted under the drive of the servo motor II 44 via the gear III 42, the racks III 43 and the guide rails V 63, so that the pitch diameters formed by the axes of the upper pressure heads 67 are equal to the pitch diameters of the bolt holes of the wheel; the servo motor III 56 drives the upper spline sleeve 51 and the upper spline shaft 49 via the rotating shaft 58 and the synchronous belt II 59 to rotate; the upper spline shaft 49 drives each upper pressure head 67 via the swivel 45 to rotate, and when the axis of each upper pressure head 67 is coaxial with the axis of each bolt hole of the wheel, each upper pressure head 67 stops rotating; the cylinder IV 55 drives each upper pressure head 67 via the upper spline shaft 49 and the upper guide post 47 to descend; the radial positions of the compression blocks 34 are adjusted under the drive of the servo electric cylinders II 39 via the guide rails IV 38, so that the compression blocks 34 are arranged above an upper flange of the wheel; the cylinders III 40 drive the compression blocks 34 via the guide posts II 35 to compress the front side of the wheel; a hushing arranged below each upper pressure head 67 can be simultaneously pressed into each bolt hole of the wheel under the drive of the servo electric cylinder III 61 via the guide post III 65, and the press-in force value of each bushing can be acquired via the upper pressure sensor 66; each bushing can be separately ejected out of the bolt hole of the wheel under the drive of the servo electric cylinder I 15 via the upper end face of the guide post I 18, and whether the press-out force of each bushing is qualified can be detected via the lower pressure sensor 19.

The foregoing descriptions of specific exemplary embodiments of the present application have been presented for purposes of illustration and description. They are not intended to be exhaustive or to limit the application to the precise forms disclosed, and obviously many modifications and variations are possible in light of the above teachings. The exemplary embodiments were chosen and described in order to explain certain principles of the application and their practical application, to thereby enable others skilled in the art to make and utilize various exemplary embodiments of the present application, as well as various alternatives and modifications thereof. It is intended that the scope of the application be defined by the Claims appended hereto and their equivalents.

What is claimed is:

1. A wheel assembly equipment comprising a frame, a cylinder I, a lower rotary joint, a lower spline shaft, a belt pulley I, a lower spline sleeve, lower guide posts, lower guide sleeves, a lower fixed plate, a lower bearing seat, a rotary bottom plate, a servo motor I, a gear I, racks I, servo electric cylinders I, left sliding plates I, guide rails I, guide posts I, lower pressure sensors, guide sleeves I, springs I, floating columns I, a spring II, a floating column II, a flange plate, a cylinder II, a gear II, a sliding rack, racks II, guide rails II, guide rails III, a left sliding plate II, clamping blocks, compression blocks, guide posts II, guide sleeves II, left sliding plates III, guide rails IV, servo electric cylinders II, cylinders III, an upper fixed plate I, a gear III, racks III, a servo motor II, a swivel, an upper fixing ring, upper guide posts, an upper fixed plate II, an upper spline shaft, a belt pulley III, an upper spline sleeve, an upper bearing seat I, upper guide sleeves, an upper rotary joint, a cylinder IV, a servo motor III, an upper bearing seat II, a rotating shaft, a synchronous belt II, a belt pulley IV, servo electric cylinders III, right sliding plates I, guide rails V, guide sleeves III, guide posts III, upper pressure sensors, upper pressure heads, clamping jaws, springs III, a right sliding plate II, a servo motor IV, a synchronous belt I, a belt pulley II, and cylinders V:

a lower rotating and lifting system comprises: the lower bearing seat is fixed above the lower fixed plate; the lower spline sleeve is mounted inside the lower bearing seat via a bearing; the lower spline shaft is matched with the lower spline sleeve, and lower end of the lower spline shaft is mounted above the lower rotary joint; the cylinder I is fixed at bottom of the frame, and output end of the cylinder I is connected with lower part of the lower rotary joint; the belt pulley I is fixed below the lower spline sleeve; the servo motor IV is fixed above the lower fixed plate, and the belt pulley II is fixed at output end of the servo motor IV; and the belt pulley I is connected with the belt pulley II via the synchronous belt I;

a lower ejection unit comprises: the left sliding plate I is fixed below the flange plate via the guide rail I; the guide sleeve I is fixed above the left sliding plate I; the guide post I is matched with the guide sleeve I; the lower pressure sensor is arranged in the middle of the guide post I; the floating column I is matched with a cylindrical hole in upper part of the guide sleeve I; the spring I is arranged below the floating column I; the servo electric cylinder I is arranged below the left sliding plate I, and output end of the servo electric cylinder I is connected with lower part of the guide post I; and quantity of the lower ejection unit of this equipment corresponds to that of bolt holes of a wheel;

a lower supporting and adjusting system comprises: the flange plate is fixed above the rotary bottom plate via a vertical plate; lower guiding part of the floating column II is matched with a hole in the middle of the flange plate; the spring II is arranged outside the lower guiding part of the floating column II; the servo motor I is fixed below the flange plate, and the gear I is fixed at output end of the servo motor I; a rack I is fixed on each left sliding plate I, and all the racks I are engaged with the gear I;

a centering and lifting system comprises: both the left sliding plate II and the right sliding plate II are mounted above a bottom plate of the sliding rack via the guide rails III; two clamping blocks are respectively fixed above the left sliding plate II and the right sliding plate II, and the racks II are respectively fixed below the left sliding plate II and the right sliding plate II; the gear II is fixed above a bottom plate of the sliding rack, and engaged with the racks II; two sides of the sliding rack are mounted on two sides of the frame via the guide rails II; the cylinder II is fixed above the bottom plate of the sliding rack, and output end of the cylinder II is connected with the left sliding plate II; four lower guide posts are fixed below the bottom plate of the sliding rack; the lower guide posts are matched with the lower guide sleeves; the lower guide sleeves are fixed on the lower fixed plate; two cylinders V are also fixed on the lower fixed plate, and output ends of the two cylinders V are articulated with lower part of the bottom plate of the sliding rack;

a compression unit comprises: the left sliding plate III is mounted below the upper fixed plate I via the guide rail IV; the guide sleeve II is fixed below the left sliding plate III; the guide post II is matched with the guide sleeve II, and the compression block is fixed below the guide post II; the cylinder III is fixed above the left sliding plate III, and output end of the cylinder III is connected with upper part of the guide post II; the servo electric cylinder II is fixed below the upper fixed plate I, and output end of the servo electric cylinder II is connected with the left sliding plate III; and this equipment comprises four compression units, the four compression units are uniformly distributed below the upper fixed plate I;

a press-in unit comprises: the right sliding plate I is mounted above the upper fixed plate I via the guide rail V; the guide sleeve III is fixed below the right sliding plate I; the guide post III is matched with the guide sleeve III, and each of the upper pressure heads is fixed below the guide post III; the upper pressure sensor is arranged inside the guide post III; upper parts of four clamping jaws are T-shaped, and matched with four T-shaped grooves in the upper pressure heads; a semi-circular stop block is respectively arranged on lower outer sides of the clamping jaws; the spring III is arranged among the four clamping jaws; the servo electric cylinder III is fixed at top of the right sliding plate I, and output end of the servo electric cylinder III is connected with upper part of the guide post III; and quantity of the press-in unit corresponds to that of the bolt holes of the wheel;

a servo motor II is fixed above the upper fixed plate I, and the gear III is fixed at output end of the servo motor II; a rack III is fixed on each right sliding plate I, and the racks III are simultaneously engaged with the gear III;

an upper lifting and rotating system comprises: the upper fixed plate II is fixed above the upper fixed plate I; the upper fixing ring is mounted above the upper fixed plate II via the swivel; four upper guide posts are fixed on the upper fixing ring; the upper guide sleeves matched with the upper guide posts are fixed above the frame; the upper bearing seat I is fixed in the middle below a top plate of the frame; the upper spline sleeve is mounted inside the upper bearing seat I via a bearing; the upper spline shaft is matched with the upper spline sleeve, upper part of the upper spline shaft is connected with lower end of the upper rotary joint, and the lower part of the upper spline shaft is connected with top of the upper fixed plate II; the belt pulley III is fixed below the upper spline sleeve; the cylinder IV is fixed at top of the frame, and output end of the cylinder IV is connected with upper end of the upper rotary joint; the upper bearing seat II is fixed on the right side below the top plate of the frame; the rotating shaft is mounted inside the upper bearing seat II via a bearing; the servo motor III is fixed above the frame; the belt pulley IV is fixed below the rotating shaft; and the belt pulley III is connected with the belt pulley IV via the synchronous belt II.

* * * * *